US006622634B2

(12) United States Patent
Cylvick

(10) Patent No.: US 6,622,634 B2
(45) Date of Patent: Sep. 23, 2003

(54) AMUSEMENT RIDE EMPLOYING A SUSPENDED TENSIONED STATIC CABLE

(76) Inventor: Eric Scott Cylvick, P.O. Box 68-1445, Park City, UT (US) 84060

( * ) Notice: Subject to any disclaimer, the term of this patent is extended or adjusted under 35 U.S.C. 154(b) by 0 days.

(21) Appl. No.: 10/225,885

(22) Filed: Aug. 22, 2002

(65) Prior Publication Data

US 2003/0066453 A1 Apr. 10, 2003

Related U.S. Application Data

(60) Provisional application No. 60/328,149, filed on Oct. 10, 2001.

(51) Int. Cl.[7] ..... A63G 7/00
(52) U.S. Cl. ..... 104/53
(58) Field of Search ..... 104/112, 113, 104/117.1, 53, 173.1, 31, 173.2, 178, 249, 250, 251; 105/151; 182/10, 11, 36; 212/76, 86; 188/65.1

(56) References Cited

U.S. PATENT DOCUMENTS 4,442,918 A * 4/1984 Rhoads, Sr. ..... 182/10
4,474,262 A * 10/1984 Himmelrich ..... 182/5
4,934,277 A * 6/1990 Smith et al. ..... 104/113
5,094,171 A * 3/1992 Fujita ..... 104/115
5,224,425 A 7/1993 Remington ..... 104/53
5,660,113 A 8/1997 Lehotsky ..... 104/113

* cited by examiner

*Primary Examiner*—S. Joseph Morano
*Assistant Examiner*—Frantz F. Jules
(74) *Attorney, Agent, or Firm*—William E. Hein

(57) ABSTRACT

A recreational ride employs a suspended tensioned static cable that allows the user to gravitationally ride, harnessed to a rolling device attached to the cable, from an upper cable support structure to a lower cable support structure at a speed that is preset, based on the difference in elevation between the upper and lower cable support structures, and that is not controlled by the user during the ride. An additional static safety cable and a terminal braking system provide an extra measure of safety for the rider in the event of failure of a primary brake contained within the rolling device or of failure of the riding cable itself.

12 Claims, 5 Drawing Sheets

AMUSEMENT RIDE EMPLOYING A SUSPENDED TENSIONED STATIC CABLE

REFERENCE TO RELATED APPLICATION

This application incorporates the subject matter of and claims priority from U.S. provisional Patent Application Serial No. 60/328,149 filed Oct. 10, 2001.

BACKGROUND AND SUMMARY OF THE INVENTION

This invention relates generally to suspended cable systems employed for a variety of purposes and, more particularly, to a recreational or amusement ride employing a suspended tensioned static cable system and a rolling device coupled thereto for gravitationally carrying a user along a span of the cable system between two cable support structures.

Suspended cable systems of various types are known in the prior art. For example, U.S. Pat. No. 4,934,277 to Smith et al. describes a system for rescuing persons stranded on aerial transportation systems that employ a wire rope or cable as the primary drive and support mechanism, such as ski lifts, oil derrick escape mechanisms, gondolas, aerial tramways, etc.

U.S. Pat. No. 5,224,425 to Remington is directed to a cable skydiving apparatus in which a rider on a pulley block car descends a mountainside along a catenary cable and generally comes to a stop as the result of frictional forces, before hitting the lower cable support point.

U.S. Pat. No. 5,660,113 to Lehotsky describes an aerial cable support system that includes a moving cable and that allows snow skiers to jump from cliffs and other elevated surfaces while eliminating a high impact landing.

As applicant is presently informed, there is no prior art teaching of a recreational ride employing a suspended tensioned static cable that allows the user to gravitationally ride, harnessed to a rolling device attached to the cable, from an upper cable support structure to a lower cable support structure at a speed that is preset, based on the difference in elevation between the upper and lower cable support structures, and that is not controlled by the user during the ride. An additional static safety cable and a terminal braking system provide an extra measure of safety for the rider in the event of failure of a primary brake contained within the rolling device or of failure of the riding cable itself.

DETAILED DESCRIPTION OF THE PREFERRED EMBODIMENT

Figure 1:
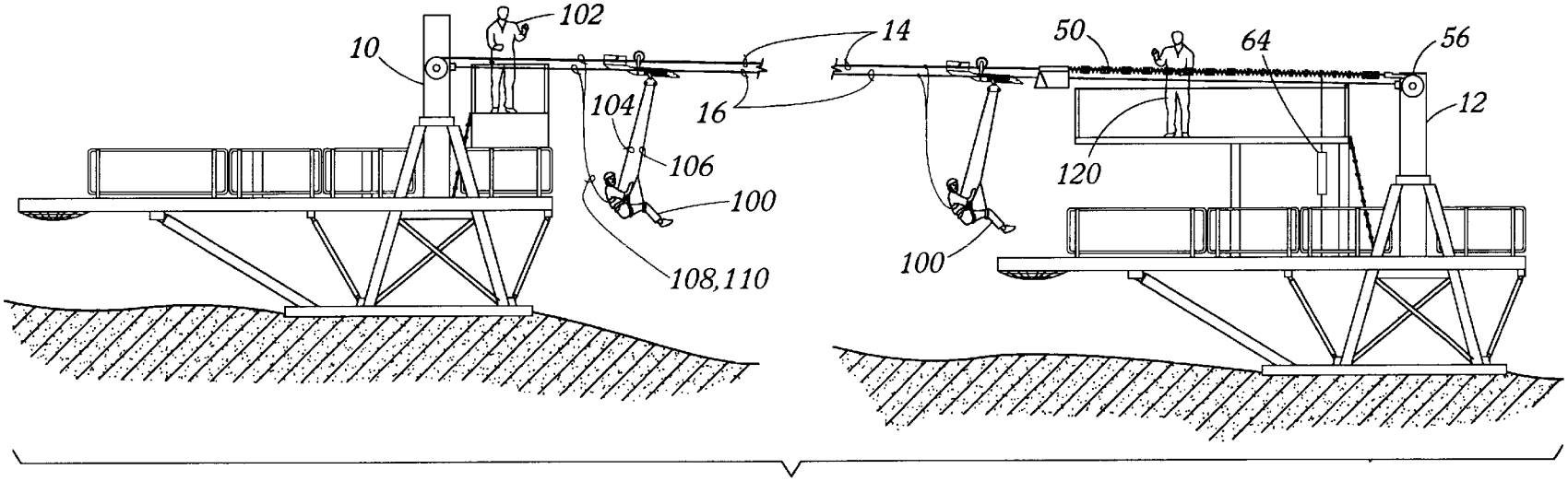
FIG. 1 is a pictorial diagram illustrating upper and lower cable support structures, tensioned static riding and safety cables spanning the support structures, and the general position of a rider at the departure and terminal points of the span.
Figure 2:
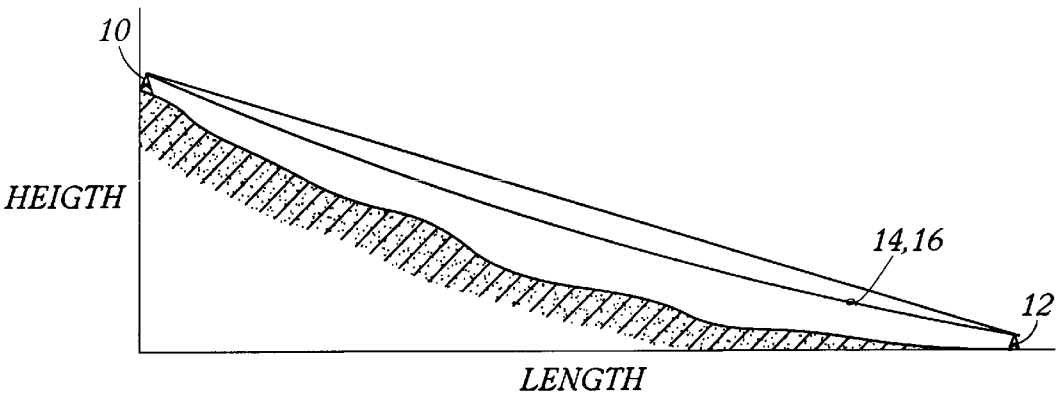
FIG. 2 is a diagram illustrating typical terrain between the upper and lower support structures of FIG. 1, a straight line approximation of the position of a tensioned cable spanning the two structures, and the actual position of the cable resulting from slight cable sag.
Figure 3:
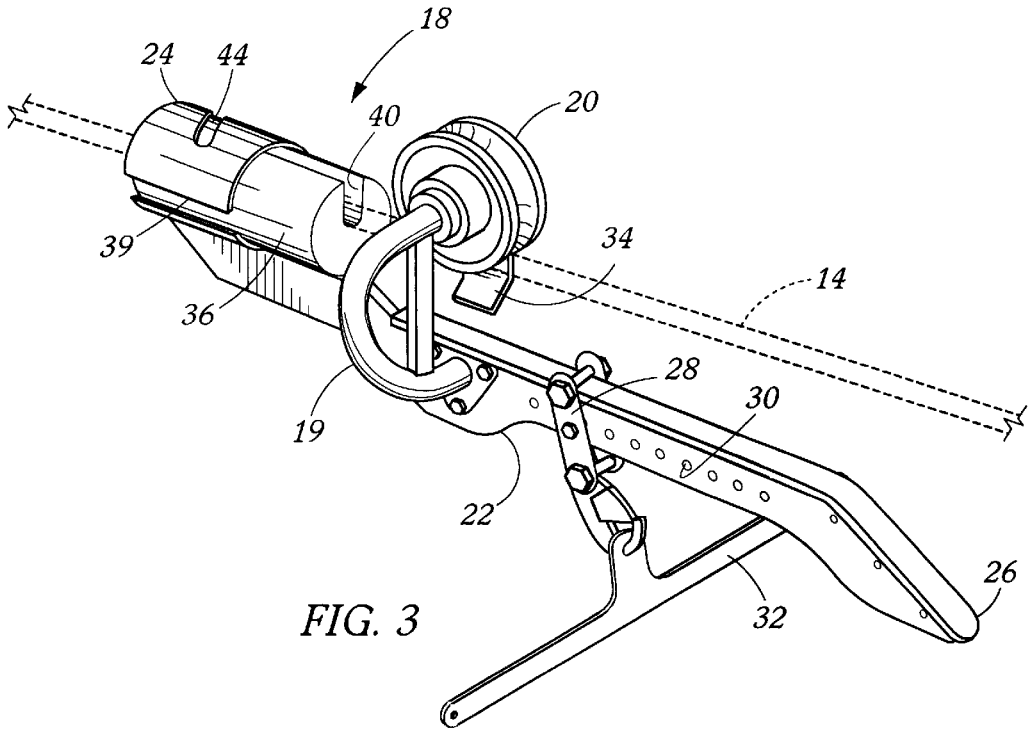
FIG. 3 is a front pictorial diagram of a rolling device that is attached to the static riding cable of FIG. 1 for supporting a rider harnessed to the rolling device during a ride.
Figure 4:
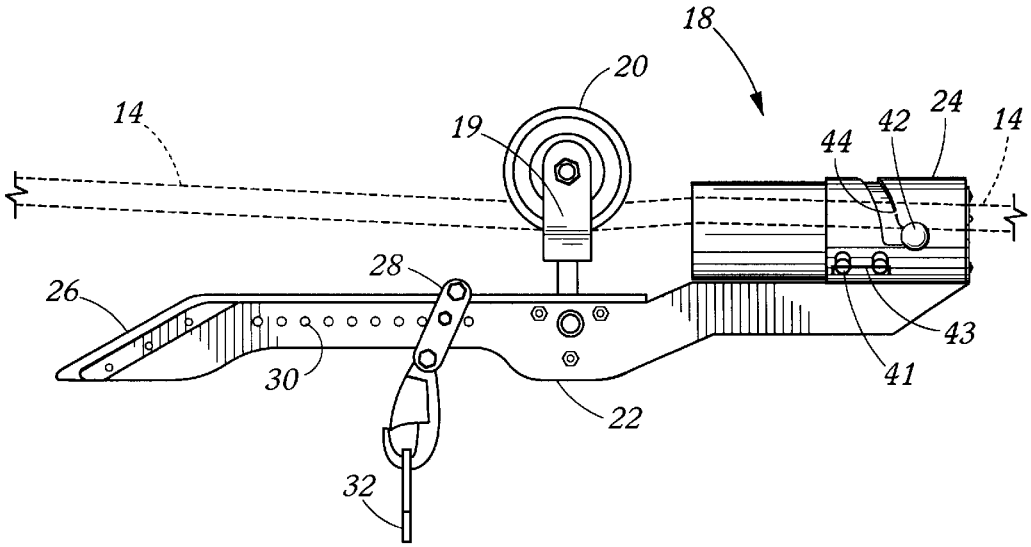
FIG. 4 is a rear elevation view of the rolling device of FIG. 3.
Figure 5:
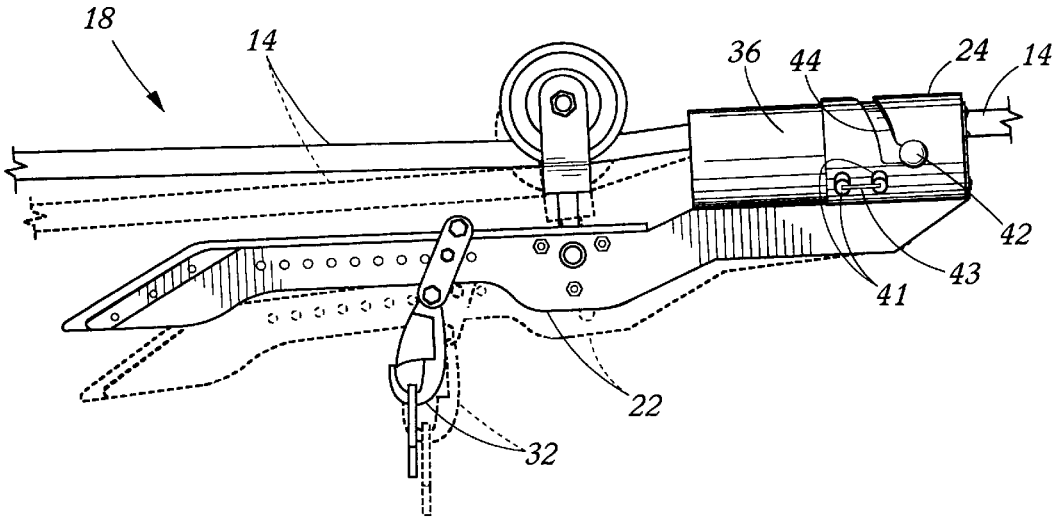
FIG. 5 is a diagram illustrating the relative positions of a brake arm of the rolling device and the tensioned static riding cable of FIGS. 3 and 4, with and without the weight of the rider applied to the brake arm.
Figure 6:
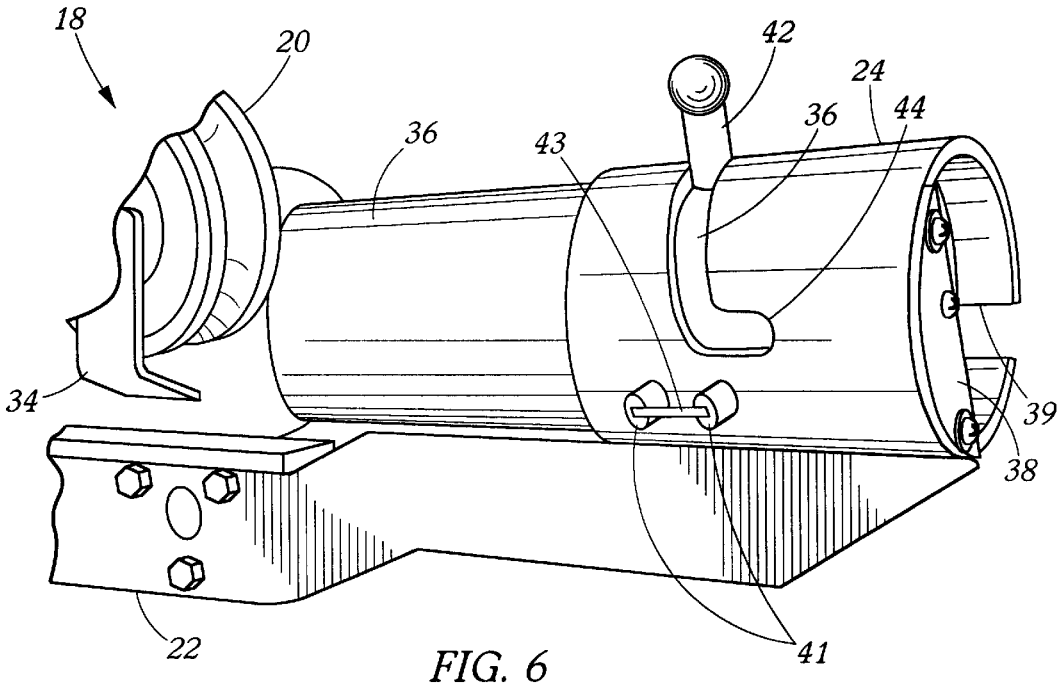
FIG. 6 is a more detailed diagram of a portion of the rolling device of FIGS. 3 and 4, illustrating the rearward portion of the brake arm and a brake assembly attached thereto.

Referring now to FIG. 1, there is shown a typical cable span of the amusement ride of the present invention, including upper and lower cable support structures 10, 12, a static riding cable 14 suspended therebetween, and a parallel safety cable 16. Additional parallel riding and safety cables 14, 16 may be installed between upper and lower cable support structures 10, 12 in order to accommodate more riders. Additional support structures may be linked to either or both of the upper and lower cable support structures 10, 12 to provide additional cable spans for a user's riding enjoyment. A typical terrain gradient between upper and lower cable support structures 10, 12 and the associated slightly sagging position of riding and safety cables 14, 16 are illustrated in FIG. 2. A terrain gradient from a minimum of 2% to more than 25% can be safely accommodated by the present invention. Support structures 10, 12 may include decks with operator platforms to facilitate the mounting and dismounting of riders by operators stationed on each deck. Conventional voice communication lines may also be provided between the upper and lower support structures 10, 12 to permit communication between operators 102, 120 stationed thereon. Control gates may be provided at the upper support structure 10 adjacent each of the riding cables 14 that are controlled to open when the operators 102, 120 are in agreement that a particular one of the riding cables 14 is clear for receiving the next rider.

Referring now additionally to FIGS. 3–6, there is shown a rolling device 18 that engages riding cable 14. Rolling device 18 includes a wheel assembly 19 having a cable wheel 20 positioned over riding cable 14, a brake arm 22, and a brake assembly 24. A bumper 26 is mounted at the leading end of brake arm 22, while brake assembly 24 is mounted to the rearward end thereof A track guide 28 is attached to one of a plurality of brake setting holes 30 provided along the central section of brake arm 22. A spreader bar 32 that is part of a rider harness is adapted for removable attachment to a snap hook that depends from track guide 28 such that spreader bar 32 hangs from track guide 28 in a position that is perpendicular to both rolling device 18 and riding cable 14. The positioning of track guide 28 in a particular one of the brake setting holes 30 determines the amount of braking applied to riding cable 14 by brake assembly 24, as a function of the difference in elevation between the upper and lower support structures 10, 12, independent of the weight of the rider. Thus, once the proper one of brake setting holes 30 has been chosen for a particular cable span, by means of an iterative process employing sand bags of known weight, the chosen brake setting hole is used for all riders, regardless of weight. The desired braking action is chosen such that a rider's terminal speed, when entering a terminal brake 50 at the lower end of riding cable 14, will be approximately ten miles per hour.

Cable wheel 20 preferably includes pressed sealed bearings. A cable guide 34 is mounted to wheel assembly 19 and over riding cable 14 to prevent separation of riding cable 14 from wheel assembly 19.

Brake assembly 24 includes a generally cylindrical body that contains a cylindrical brake pad 36 fabricated of conventional brake material. The brake pad 36 may be inserted into or removed from brake assembly 24 through a frontal opening in the cylindrical body thereof by first removing wheel assembly 19 therefrom. A brake pad stop 38 is provided at the rear end of the cylindrical body of brake assembly 24 to retain brake pad 36 within brake assembly 24 when in use. The cylindrical body of brake assembly 24 includes a longitudinal slot 39 therein, through which rolling device 18 is attached to and removed from riding cable 14. Brake pad 36 includes a similar longitudinal cable slot 40 formed therein for engaging riding cable 14. A brake pad locking pin 42 is threaded into brake pad 36 through a brake pad locking guide 44 provided in the cylindrical body of brake pad assembly 24. Brake pad locking pin 42 controls rotational movement of brake pad 36 within the cylindrical body of brake pad assembly 24. A pair of brake pad plunger pins 41, coupled together by a grab bar 43, are located on the wall of the cylindrical body of brake pad assembly 24 forward of locking pin 42. Brake pad plunger pins 41 fit into aligned holes provided in the brake pad 36 when the brake pad locking pin 42 is in its downward locked position in the horizontal portion of locking guide 44. When brake pad plunger pins 41 are so positioned, they serve to securely lock brake pad 36 in place. In this locked position, riding cable 14 is, of course, fully encased within the cylindrical body of brake assembly 24 with the slot 40 in brake pad 36 facing upwardly and engaging riding cable 14. The weight of a rider 100, suspended from spreader bar 32 near the leading end of brake arm 22, produces, through a pivot point provided by wheel assembly 19, an upward force at brake assembly 24, resulting in brake pad 36 being urged upwardly against riding cable 14 to produce the desired normal braking action during the course of a ride. In order to remove rolling device 18 from riding cable 14 at the end of a ride, the bottom operator 120 must manually pull grab bar 43 to remove brake pad plunger pins 41 from their holes in brake pad 36, while at the same time moving locking pin 42 from its locked position in locking guide 44 to its unlocked position shown in FIG. 6 at the top of the vertical portion of locking guide 44. In this unlocked position, the slot 39 in the cylindrical body of brake assembly 24 is aligned with the slot 40 in brake pad 36, thereby permitting the rolling device 18 to be removed from or attached over riding cable 14.

Figure 7:
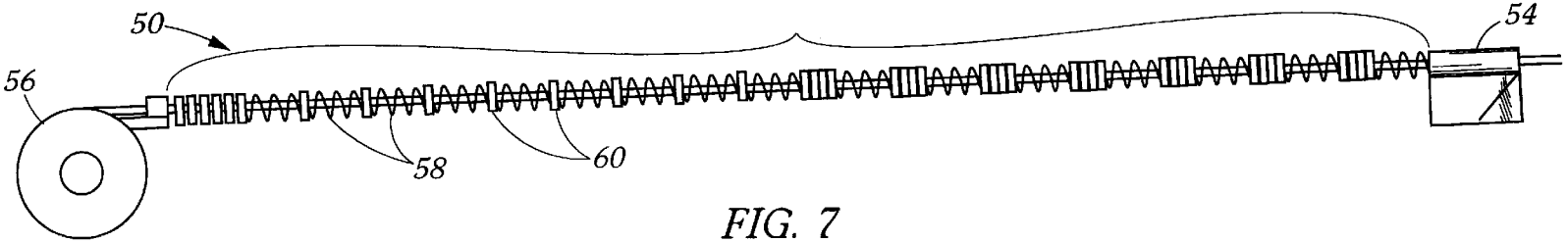
FIG. 7 is a pictorial diagram of a terminal brake positioned at the terminal end of the riding cable of FIG. 1.
Figure 8:
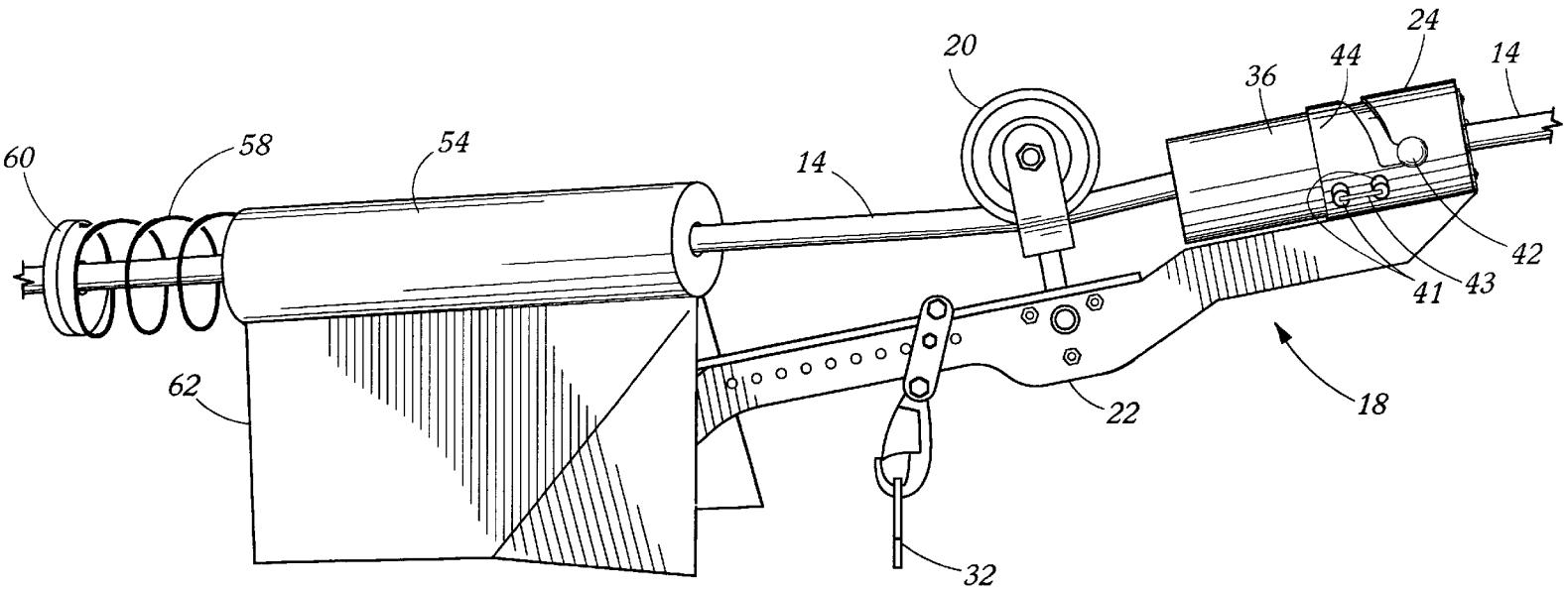
FIG. 8 is a detailed diagram illustrating a terminal brake acceptor portion of the terminal brake of FIG. 7 and the way in which an approaching rolling device engages the terminal brake acceptor.

Referring now to FIGS. 7 and 8, there is shown a terminal brake 50 that includes a dampening system 52 and a terminal brake acceptor 54. Terminal brake 50 is positioned concentrically over riding cable 14 proximate a fixed cable hanger 56 at the lower cable support structure 12 of FIG. 1. Dampening system 52 includes a series of alternating springs 58 and weights 60, which are attached to each other and which move as a unit over the terminal end of riding cable 14. Terminal brake acceptor 54 is attached to dampening system 52 at the uphill end thereof and includes a downwardly extending inverted V-shaped member that receives bumper 26 at the leading end of brake arm 22 as the rider approaches the terminal end of riding cable 14. As brake arm 22 enters terminal brake acceptor 54, brake arm 22 is forced downwardly, which increasingly forces brake pad 36 upwardly against riding cable 14 to further decrease the speed of the rider. Springs 58 and weights 60 are chosen through conventional computations to have a compressive strength and weight, respectively, such that they safely serve to decelerate a 300-pound runaway rider without the added braking assistance provided by brake arm 22 entering terminal brake acceptor 54. Under normal operating conditions, the combination of dampening system 52 and terminal brake acceptor 54 will smoothly decelerate a rider over approximately a fifteen-foot distance.

Figure 9:
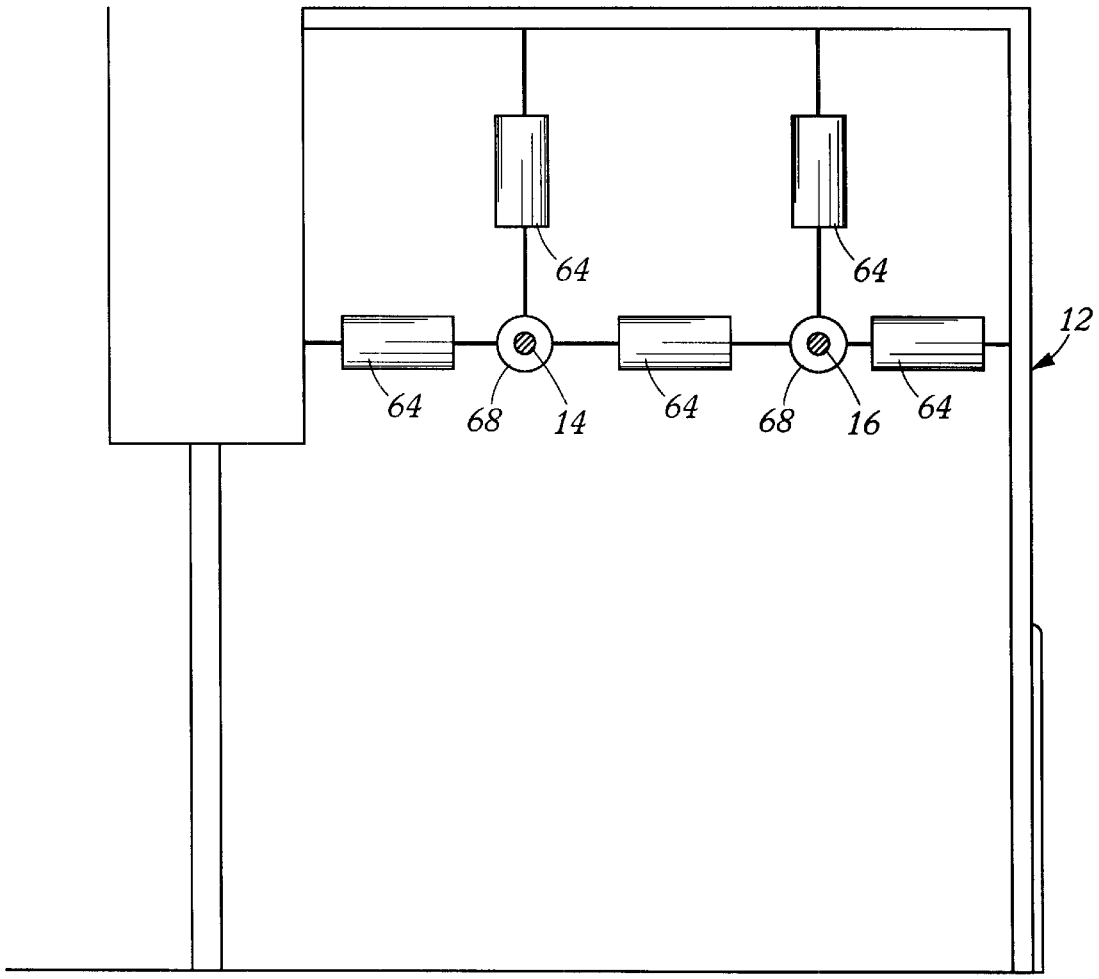
FIG. 9 is a pictorial diagram showing the riding and safety cables of FIG. 1 in cross section proximate the lower support structure, along with horizontal and vertical dampeners connected between the two cables and the lower support structure.

Referring to FIG. 9, there are shown a plurality of horizontal and vertical cable dampeners 64 and 66, respectively, each of which may comprise a commercially available shock absorber, for example. Horizontal and vertical cable dampeners 64, 66 are connected between tubes 68, that are concentrically positioned over a short length of each of the riding and safety cables 14, 16, and the lower cable support structure 12 Each of the tubes 68 is typically six feet in length. Cable dampeners 64, 66 serve to dampen any oscillation that may develop, as the result of wind, for example, in either riding cables 14 or safety cables 16.

In preparation for a ride, a rider 100 is fitted into a harness that may comprise a conventional climbing harness, for example, and that includes a pair of conventional chest lanyards 104, 106 that are coupled to spreader bar 32. The climbing harness also includes primary and secondary safety lanyards 108, 110. Rider 100 is also issued a rolling device 18. An upper operator 102 stationed on upper cable support structure 10 attaches the rolling device 18 to riding cable 14, clips the primary and secondary safety lanyards 108, 110 to riding and safety cables 14, 16, and also clips spreader bar 32 to the snap hook that depends from track guide 28 of rolling device 18. During the course of a ride, safety lanyards 108, 110 trail rolling device 18. Safety lanyards 108, 110 become tensioned only in the event of a complete failure of rolling device 18 or riding cable 14 to prevent the rider from falling to the ground. When the ride is completed, a lower operator 120, stationed on lower cable support structure 12, unclips the spreader bar 32 from track guide 28, unclips primary and secondary safety lanyards 108, 110, and removes rolling device 18 from riding cable 14, so that the rider is free to disembark the lower cable support structure 12.

I claim:

1. An amusement ride comprising upper and lower earth-mounted cable support structures positioned such that said upper cable support structure is at a higher terrain elevation than said lower support structure;

a static tensioned riding cable connected between said upper and lower support structures;

a rolling device adapted for removable rolling engagement with said riding cable, said rolling device being further adapted to support a harnessed rider suspended therefrom, said rolling device comprising a brake arm and a cable wheel assembly connected to said brake arm so as to extend upwardly therefrom, said cable wheel assembly comprising a cable wheel adapted for rolling engagement with said riding cable, said rolling device further comprising a generally cylindrical brake assembly mounted atop said brake arm proximate a rear end thereof, said brake assembly having a central longitudinal axis generally aligned with said cable wheel, said brake assembly further comprising a generally cylindrical brake pad removably positioned therein, said brake pad having a radial cable slot longitudinally formed therein, said brake assembly having a longitudinal aperture in a cylindrical wall thereof, said brake assembly further comprising a brake pad stop at a rear opening thereof for retaining said brake pad within said brake assembly during operation of the amusement ride, said brake assembly further comprising means for rotating said brake pad positioned therein between an unlocked position in which said cable slot in said brake pad is radially aligned with said aperture in said cylindrical wall of said brake assembly to thereby permit entry of said riding cable into said cable groove and a locked position in which said cable slot faces upwardly within said brake assembly to thereby retain said riding cable within said brake assembly.

2. An amusement ride as in claim 1, further comprising a static tensioned safety cable connected between said upper and lower support strutures for slidably receiving safety lanyards coupled to said rider.

3. An amusement ride as in claim 1, wherein said means for rotating said brake pad comprises:

a brake pad locking pin inserted into said brake pad and extending outwardly through a brake pad locking guide formed in said cylindrical wall of said brake assembly, said brake pad locking pin being movable within said brake pad locking guide between points therein that define said locked and unlocked positions.

4. An amusement ride as in claim 3, further comprising one or more brake pad plunger pins removably insertable through an opening in said cylindrical wall of said brake assembly into an aligned radial opening in said brake pad for maintaining said brake pad in said locked position.

5. An amusement ride as in claim 1, wherein said brake arm further comprises a plurality of longitudinally-aligned brake setting holes for receiving a track guide in a selected one thereof, said track guide being adapted to receive a spreader bar coupled to said harnessed rider, said selected one of said brake setting holes being chosen to provide a desired degree of braking action resulting from said brake pad being forced upwardly against said riding cable when said brake pad is in said locked position during operation of the amusement ride.

6. An amusement ride as in claim 1, wherein said cable wheel is adapted for removable attachment to said cable wheel assembly to facilitate the engagement and disengagement of said rolling device with said riding cable.

7. An amusement ride as in claim 1, further comprising a terminal brake assembly, coaxially positioned over said riding cable proximate said lower support structure, said terminal brake assembly comprising a dampening system comprising a longitudinal alternating series of springs and weights attached to each other and coaxially positioned over said riding cable at a terminal end thereof proximate said lower support structure, said terminal brake assembly being operative for safely decelerating a runaway rider approaching the terminal end of said riding cable.

8. An amusement ride as in claim 7, wherein said terminal brake assembly further comprises a terminal brake acceptor positioned at a leading end of said dampening system and having a depending inverted v-shaped guide member for receiving a leading end of said brake arm of an approaching rolling device having a rider suspended therefrom, said guide member being operative for forcing said leading end of said brake arm downwardly to thereby increasingly force said brake pad upwardly against said riding cable and thus further slow said approaching rolling device.

9. An amusement ride as in claim 1, further comprising a cable dampening system for controlling wind-driven and other undesirable oscillations in said riding cable, said cable dampening system comprising a cylindrical dampening tube coaxially positioned over a length of said riding cable at a terminal end thereof proximate said lower support structure and a plurality of vertical and horizontal cable dampeners connected between said dampening tube and said lower support structure.

10. An amusement ride as in claim 2, further comprising a cable dampening system for controlling wind-driven and other undesirable oscillations in said riding and safety cables, said cable dampening system comprising a cylindrical dampening tube coaxially positioned over a length of each of said riding and safety cables at terminal ends thereof proximate said lower support structure and a plurality of vertical and horizontal cable dampeners connected between each of said dampening tubes and said lower support structure.

11. An amusement ride as in claim 2, further comprising one or more additional static tensioned riding and safety cables connected between said upper and lower support structures and corresponding additional ones of said rolling device to accommodate additional riders.

12. An amusement ride as in claim 1, further comprising one or more additional cable support structures and corresponding additional ones of said riding cable linked to one or both of said upper and lower support structures to provide additional cable spans to increase a rider's enjoyment of the amusement ride.

* * * * *